US011708653B2

(12) United States Patent
Pots et al.

(10) Patent No.: US 11,708,653 B2
(45) **Date of Patent: *Jul. 25, 2023**

(54) MICROFIBER-CONTAINING NONWOVEN FABRICS

(71) Applicant: Berry Global, Inc., Evansville, IN (US)

(72) Inventors: Dionne Pots, 's-Hertogenbosch (NL); Matthijs Van Hunen, Arhem (NL); James Taylor, Chelmsford (GB)

(73) Assignee: BERRY GLOBAL, INC., Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/870,411

(22) Filed: Jul. 21, 2022

(65) Prior Publication Data

US 2022/0356620 A1 Nov. 10, 2022

Related U.S. Application Data

(63) Continuation of application No. 16/702,748, filed on Dec. 4, 2019, now Pat. No. 11,441,252.

(60) Provisional application No. 62/776,257, filed on Dec. 6, 2018.

(51) Int. Cl.

| | |
|---|---|
| ***D04H 5/02*** | (2012.01) |
| ***D04H 13/00*** | (2006.01) |
| ***A47L 13/16*** | (2006.01) |
| ***A47L 13/22*** | (2006.01) |

(52) U.S. Cl.

CPC ..... *D04H 5/02* (2013.01); *A47L 13/16* (2013.01); *A47L 13/22* (2013.01); *D04H 13/001* (2013.01); *D04H 13/002* (2013.01); *D10B 2331/04* (2013.01)

(58) Field of Classification Search

CPC . D04H 5/02; D04H 5/08; D04H 11/00; D04H 11/04; D04H 13/001; D04H 13/002; A47L 13/16; A47L 13/22; A47L 13/20; A47L 13/24; A47L 13/25; A47L 13/254;

(Continued)

(56) References Cited

U.S. PATENT DOCUMENTS

| | | | |
|---|---|---|---|
| 6,314,627 | B1 | 11/2001 | Ngai |
| 6,540,424 | B1 | 4/2003 | Hall et al. |
| 6,641,695 | B2 | 11/2003 | Baker |

(Continued)

FOREIGN PATENT DOCUMENTS

| | | | |
|---|---|---|---|
| EP | 2348146 | A1 | 7/2011 |
| EP | 3034667 | A1 | 6/2016 |

(Continued)

OTHER PUBLICATIONS

International Search Report and Written Opinion of international application No. PCT/US2019/064368 dated Feb. 24, 2020, all enclosed pages cited.

(Continued)

*Primary Examiner* — David J Walczak

(74) *Attorney, Agent, or Firm* — Burr & Forman LLP

(57) ABSTRACT

Nonwoven fabrics including (i) continuous fibers and (ii) a blend of staple fibers comprising polyester staple fibers, bicomponent staple fibers, microfiber staple fibers, and wettable staple fibers, in which the continuous fibers are mechanically entangled with the blend of staple fibers. The continuous fibers and the blend of staple fibers may be mechanically entangled via a hydroentangling process.

20 Claims, 9 Drawing Sheets

(58) Field of Classification Search
CPC ..... A47L 13/256; D10B 2331/04; D10B 2331/00
USPC ..... 401/137–140
See application file for complete search history.

(56) References Cited

U.S. PATENT DOCUMENTS

| | | | |
|---|---|---|---|
| 6,735,833 | B2 | 5/2004 | Putnam et al. |
| 6,903,034 | B1 | 6/2005 | Putnam et al. |
| 7,091,140 | B1 | 8/2006 | Ferencz et al. |
| 7,406,755 | B2 | 8/2008 | Putnam et al. |
| 7,699,551 | B2 | 4/2010 | Suda |
| 9,480,608 | B2 | 11/2016 | Kirby |
| 11,007,093 | B2 | 5/2021 | Beltz |
| 2005/0085149 | A1 | 4/2005 | Sommer |
| 2006/0200933 | A1 | 9/2006 | McDonnell |

FOREIGN PATENT DOCUMENTS

| | | | |
|---|---|---|---|
| JP | H10331063 | A | 12/1998 |
| WO | 200152713 | A2 | 7/2001 |
| WO | 2006001739 | A1 | 1/2006 |

OTHER PUBLICATIONS

Second Written Opinion of international application No. PCT/US2019/064368 dated Nov. 6, 2020, all enclosed pages cited.
International Preliminary Report on Patentability of international application No. PCT/US2019/064368 dated Feb. 12, 2021, all enclosed pages cited.

MICROFIBER-CONTAINING NONWOVEN FABRICS

CROSS-REFERENCE TO RELATED APPLICATIONS

This application is a continuation of U.S. application Ser. No. 16/702,748 filed Dec. 4, 2019, which claims priority under 35 U.S.C. § 119(e) to U.S. Provisional Application No. 62/776,257, filed Dec. 6, 2018, each of which are expressly incorporated by reference herein in their entirety.

TECHNICAL FIELD

Embodiments of the presently-disclosed invention relate generally to microfiber-containing nonwoven fabrics, such as disposable mopping wipes, including mechanically entangled continuous fibers and a blend of staple fibers. Embodiments of the presently-disclosed invention also generally relate to methods of making such microfiber-containing nonwoven fabrics.

BACKGROUND

Dust and dirt build-up is inevitable on every kind of smooth floor or surface. Such a build-up of dust and dirt is not only unattractive but also unhygienic, triggers allergies, and generally creates health and safety concerns. Traditional floor and surface cleaning fabrics may contribute to these problems by transferring dirt and grime from one area to another and being returned to service from the laundry still contaminated with bacteria from previous use.

For instance, dust can often be a breeding ground for bacteria and when combined with the moist conditions of wet mopping the bacteria growth can accelerate. In this regard, the risk of cross-contamination may be significant when cleaning different areas with a single mop. In healthcare settings, for example, a single mop can only be used to clean one area or room to prevent cross-contamination. Accordingly, a mop or other cleaning implement is not used for a long period of time to prevent cross-contamination in critical areas in which mops and cleaning instruments are used.

Additionally, traditional wet mops are generally limited in the area (e.g., in square meters) that may be cleaned with a single mop and most disposable mops can only clean a limited area before drying out. Outside of high risk areas, for example, the problem is physically how much liquid a wet/damp mop can hold or retain. Current products can effectively and safely clean only up to a maximum of 25 square meters. In this regard, the distribution of cleaning liquids may undesirably vary widely from start to end, which may result in localized areas that have not been properly cleaned (e.g., failure to kill bacteria, etc.).

Therefore, there remains a need in the art for microfiber-containing nonwoven fabric, such as a disposable mopping wipes, that may be configured to pick-up and/or trap dirt thereon as well as enable an increased area that may be cleaned via wet mopping (e.g., above 25 $m^2$). There also remains a need in the art for methods of making such microfiber-containing nonwoven fabric nonwoven fabrics.

SUMMARY OF INVENTION

One or more embodiments of the invention may address one or more of the aforementioned problems. Certain embodiments according to the invention provide a nonwoven fabric comprising (i) continuous fibers and (ii) a blend of staple fibers comprising polyester staple fibers, bicomponent staple fibers, microfiber staple fibers, and wettable staple fibers, in which the continuous fibers are mechanically entangled (e.g., hydroentangled, needle-punched, air-entangled, etc.) with the blend of staple fibers. In accordance with certain embodiments of the invention, the nonwoven fabric may comprise a three-dimensional pattern on at least one surface of the nonwoven fabric. For example, the three-dimensional pattern may comprise a plurality of recessed portions configured to facilitate the capture of loose debris (e.g., dirt).

In another aspect, the present invention provides a cleaning system comprising a cleaning implement including a mop frame and a nonwoven fabric as described and disclosed herein. In accordance with certain embodiments of the invention, the nonwoven fabric may directly or indirectly attach to the mop frame. The cleaning implement, in accordance with certain embodiments of the invention, may also comprise a handle directly or indirectly attached to the mop frame. The cleaning implement, in accordance with certain embodiments of the invention, may further comprise a liquid reservoir configured to contain a liquid cleaning composition. In accordance with certain embodiments of the invention, the liquid reservoir may be mounted directly or indirectly onto the handle.

In another aspect, the present invention provides a method of forming a nonwoven fabric including forming or providing a web of continuous fibers having a top surface and forming or providing a carded web comprising a blend of staple fibers including polyester staple fibers, bicomponent staple fibers, microfiber staple fibers, and wettable staple fibers. The method may further comprise positioning the carded web directly or indirectly onto the top surface of the web of continuous filaments followed by mechanically entangling (e.g., hydroentangled, needle-punched, air-entangled, etc.) the carded web with the continuous fibers to define a nonwoven fabric as described and disclosed herein.

BRIEF DESCRIPTION OF THE DRAWING(S)

The invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout, and wherein.

DETAILED DESCRIPTION

Figure 1:
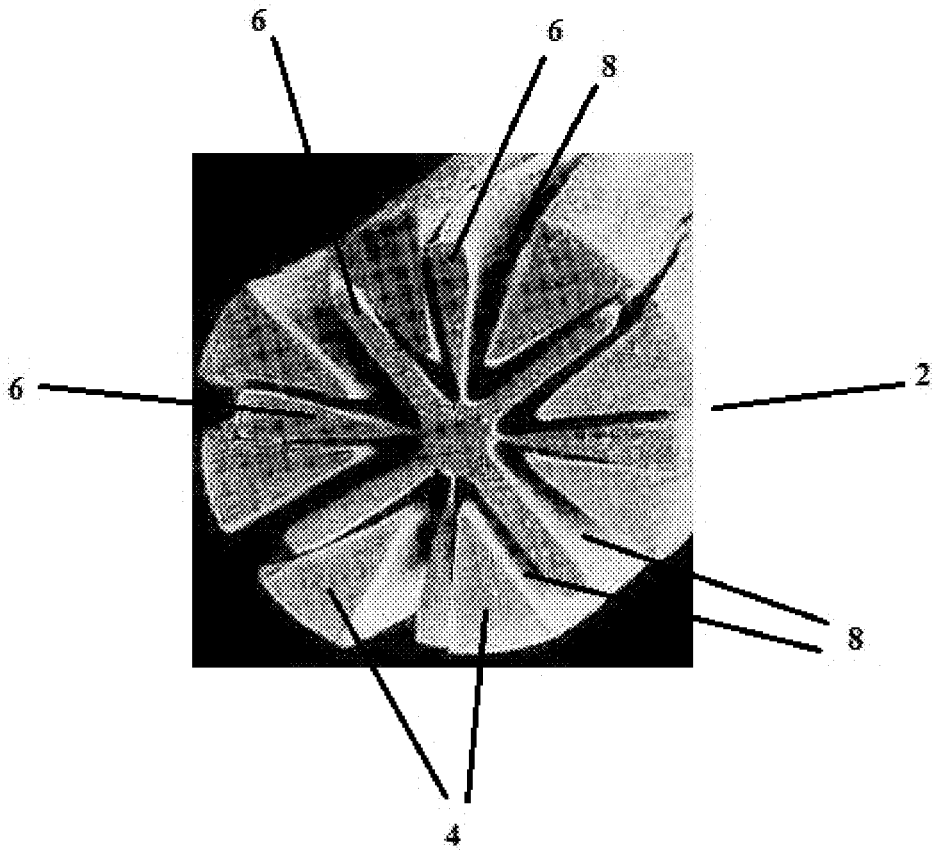
FIG. 1 is an image of a microfiber formed from two separate components that have been at least partially split from each other and having micro-pores or micro-channels defined between portions of the two split components.

The invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The presently-disclosed invention relates generally to microfiber-containing nonwoven fabrics, such as disposable mopping wipes, including mechanically entangled (i) continuous fibers and (ii) a blend of staple fibers. In accordance with certain embodiments of the invention, the nonwoven fabric provides a disposable solution to at least some of the shortcomings associated with traditional cleaning clothes (e.g., re-usable mop clothes). In accordance with certain embodiments of the invention, the nonwoven fabric provides improved pick-up of dirt and/or debris located on a surface (e.g., a floor) to be cleaned. In accordance with certain embodiments of the invention, the nonwoven fabric comprises a unique microfiber-containing nonwoven fabric that may also include a three-dimensional surface. In accordance with certain embodiments of the invention, the three-dimensional surface may comprise a plurality recessed portions (e.g., channels or pockets) configured to facilitate the pick-up and capture of dirt and/or bacteria in the nonwoven fabric.

In accordance with certain embodiments of the invention, the nonwoven fabric may comprise a disposable wipe material (e.g., mopping wipe or cloth). In this regard, the nonwoven fabric may be directly or indirectly attached or otherwise coupled to a cleaning implement (e.g., a mop frame of a mop) for use and easily disposed of when the cleaning is finished. Accordingly, certain embodiments of the invention may significantly reduce the risk of cross-contamination. In accordance with certain embodiments of the invention, the nonwoven fabric may be configured to pick-up and/or trap dirt thereon as well as enable an increased area that may be cleaned via wet mopping (e.g., above 25 $m^2$, 50 $m^2$, 75 $m^2$, 100 $m^2$, 125 $m^2$) with a single nonwoven fabric.

The terms "substantial" or "substantially" may encompass the whole amount as specified, according to certain embodiments of the invention, or largely but not the whole amount specified (e.g., 95%, 96%, 97%, 98%, or 99% of the whole amount specified) according to other embodiments of the invention.

The terms "polymer" or "polymeric", as used interchangeably herein, may comprise homopolymers, copolymers, such as, for example, block, graft, random, and alternating copolymers, terpolymers, etc., and blends and modifications thereof. Furthermore, unless otherwise specifically limited, the term "polymer" or "polymeric" shall include all possible structural isomers; stereoisomers including, without limitation, geometric isomers, optical isomers or enantiomers; and/or any chiral molecular configuration of such polymer or polymeric material. These configurations include, but are not limited to, isotactic, syndiotactic, and atactic configurations of such polymer or polymeric material. The term "polymer" or "polymeric" shall also include polymers made from various catalyst systems including, without limitation, the Ziegler-Natta catalyst system and the metallocene/single-site catalyst system. The term "polymer" or "polymeric" may also include, in according to certain embodiments of the invention, polymers produced by fermentation process or biosourced. Additionally or alternatively, the term "polymer" or "polymeric" may comprise a biopolymer, such as polylactic acid (PLA), polyhydroxyalkanoates (PHA), and poly(hydroxycarboxylic) acids.

The term "cellulosic fiber", as used herein, may comprise fibers derived from hardwood trees, softwood trees, or a combination of hardwood and softwood trees prepared for use in, for example, a papermaking furnish and/or fluff pulp furnish by any known suitable digestion, refining, and bleaching operations. The cellulosic fibers may comprise recycled fibers and/or virgin fibers. Recycled fibers differ from virgin fibers in that the fibers have gone through the drying process at least once. In certain embodiments, at least a portion of the cellulosic fibers may be provided from non-woody herbaceous plants including, but not limited to, kenaf, cotton, hemp, jute, flax, sisal, or abaca. Cellulosic fibers may, in certain embodiments of the invention, comprise either bleached or unbleached pulp fiber such as high yield pulps and/or mechanical pulps such as thermo-mechanical pulping (TMP), chemical-mechanical pulp (CMP), and bleached chemical-thermo-mechanical pulp BCTMP. In this regard, the term "pulp", as used herein, may comprise cellulose that has been subjected to processing treatments, such as thermal, chemical, and/or mechanical treatments. Cellulosic fibers, according to certain embodiments of the invention, may comprise one or more pulp materials.

The terms "nonwoven" and "nonwoven web", as used herein, may comprise a web having a structure of individual fibers, filaments, and/or threads that are interlaid but not in an identifiable repeating manner as in a knitted or woven fabric. Nonwoven fabrics or webs, according to certain embodiments of the invention, may be formed by any process conventionally known in the art such as, for example, meltblowing processes, spunbonding processes, needle-punching, hydroentangling, air-laid, and bonded carded web processes.

The term "staple fiber", as used herein, may comprise a cut fiber from a filament. In accordance with certain embodiments, any type of filament material may be used to form staple fibers. For example, staple fibers may comprise cellulosic fibers, polymeric fibers, and/or elastomeric fibers. Non-limiting examples of materials may comprise polyolefins (e.g., a polypropylene or polypropylene-containing copolymer), polyethylene terephthalate, and polyamides. Additional non-limiting examples of materials may comprise nylon, cotton, rayon, and wool. The average length of staple fibers may comprise, by way of example only, from about 2 centimeter to about 15 centimeter.

The term "continuous fiber", as used herein, may comprise a filament that has a high length-to-diameter aspect ratio (i.e., length:diameter) such as, for example, exceeding about 500,000:1, exceeding about 750,000:1, or exceeding about 1,000,000:1. In accordance with certain embodiments of the invention, the term "continuous fiber" may comprise a filament that is essentially endless in length.

The term "spunbond", as used herein, may comprise fibers which are formed by extruding molten thermoplastic material as filaments from a plurality of fine, usually circular, capillaries of a spinneret with the diameter of the extruded filaments then being rapidly reduced. According to an embodiment of the invention, spunbond fibers are generally not tacky when they are deposited onto a collecting surface and may be generally continuous. It is noted that the spunbond used in certain composites of the invention may include a nonwoven described in the literature as SPINLACE®.

The term "bicomponent fibers", as used herein, may comprise fibers formed from two different polymeric materials or compositions extruded from separate extruders but spun together to form one fiber. The polymeric materials or polymers are arranged in a substantially constant position in distinct zones across the cross-section of the multi-component fibers and extend continuously along the length of the multi-component fibers. The configuration of such a multi-component fibers may be, for example, a sheath/core arrangement wherein one polymer is surrounded by another, an eccentric sheath/core arrangement, a side-by-side arrangement, a pie arrangement, or an "islands-in-the-sea" arrangement, each as is known in the art of multicomponent, including bicomponent, fibers.

The term "microfiber", as used herein, may comprise a multicomponent fiber that has been partially split to provide a plurality of smaller fiber portions, in which the smaller fiber portions may have a decitex (dtex) of 1.0 or below. In this regard, a microfiber may include at least a first group of split fibers or fiber portions and a second group of split fibers or fiber portions due to the complete or partial splitting or separation of individual segments from a pre-split multi-component fiber, in which the "split fibers or fiber portions" may comprise the portion of an individual segment of the multicomponent fiber that has been separated or split from the original splittable multicomponent fiber (e.g., having a dtex value of below 5, 4, 3, 2, etc.). In accordance with certain embodiments of the invention, the first group of split staple fibers may comprise a first polymeric material and the second group of split staple fibers may comprise a second polymeric material that is different than the first polymeric material. FIG. 1, for example, illustrates an image of a microfiber 2 having an alternating wedges. As shown in FIG. 1, the microfiber 1 includes a first polymeric component 4 (e.g., shown having a pie-shaped configuration) and a second polymeric component 6, in which at least a portion of the first polymeric portion and the second polymeric portion have been split or separated from each other to define a plurality of micro-pores or micro-channels 8. In this regard, microfibers have an increased surface area and a channel and/or pore containing structure that allows for capillary action to facilitate the uptake and/or absorption of fluid. Microfibers, as disclosed herein, may be distinguished by the bi-component staple fibers described herein by one or more of an increased porosity due to the presence of micro-pores and/or micro-channels in the microfiber while the bi-component staple fibers described herein are devoid or substantially devoid of micro-pores and/or micro-channels.

The term "crimp" or "crimped", as used herein, may comprise a two- or three-dimensional curl or bend such as, for example, a folded or compressed portion having an "L" configuration, a wave portion having a "zig-zag" configuration, or a curl portion such as a helical configuration. In accordance with certain embodiments of the invention, the term "crimp" or "crimped" does not include random two-dimensional waves or undulations in a fiber, such as those associated with normal lay-down of fibers in a melt-spinning process.

The term "machine direction" or "MD", as used herein, comprises the direction in which the fabric produced or conveyed. The term "cross-direction" or "CD", as used herein, comprises the direction of the fabric substantially perpendicular to the MD.

The term "layer", as used herein, may comprise a generally recognizable combination of similar material types and/or functions existing in the X-Y plane.

All whole number end points disclosed herein that can create a smaller range within a given range disclosed herein are within the scope of certain embodiments of the invention. By way of example, a disclosure of from about 10 to about 15 includes the disclosure of intermediate ranges, for example, of: from about 10 to about 11; from about 10 to about 12; from about 13 to about 15; from about 14 to about 15; etc. Moreover, all single decimal (e.g., numbers reported to the nearest tenth) end points that can create a smaller range within a given range disclosed herein are within the scope of certain embodiments of the invention. By way of example, a disclosure of from about 1.5 to about 2.0 includes the disclosure of intermediate ranges, for example, of: from about 1.5 to about 1.6; from about 1.5 to about 1.7; from about 1.7 to about 1.8; etc.

In one aspect, the invention provides a nonwoven fabric comprising (i) continuous fibers and (ii) a blend of staple fibers comprising polyester staple fibers, bicomponent staple fibers, microfiber staple fibers, and wettable staple fibers, in which the continuous fibers are mechanically entangled (e.g., hydroentangled, needle-punched, air-entangled, etc.) with the blend of staple fibers. In accordance with certain embodiments of the invention, the nonwoven fabric includes a unique combination of staple fibers entangled with continuous fibers to provide unique features. In accordance with certain embodiments of the invention, the nonwoven fabric may comprise a three-dimensional pattern on at least one surface of the nonwoven fabric. For example, the three-dimensional pattern may comprise a plurality of recessed portions configured to facilitate the capture of loose debris (e.g., dirt).

In accordance with certain embodiments of the invention, the nonwoven fabric may comprise a basis weight from about 25 grams-per-square-meter (gsm) to about 200 gsm, such as about at most about any of the following: 200, 175, 150, 125, 100, and 75 gsm and/or at least about any of the following: 25, 40, 50, 60, 70, 80, 90, 100, and 125 gsm.

In accordance with certain embodiments of the invention, the continuous fibers may comprise spunbond fibers. In accordance with certain embodiments of the invention, the spunbond fiber may comprise a round cross-section or a non-cross-section (e.g., ribbon fiber having an aspect ratio of 1.5:1 or above). The continuous fibers may comprise a synthetic polymer. In accordance with certain embodiments of the invention, the synthetic polymer may comprise a polyolefin, a polyester, a polyamide, or any combination thereof. In accordance with certain embodiments of the invention, the polymer comprises a polyolefin. Examples of suitable polyolefin polymers include a polyethylene, a polypropylene, a copolymer thereof, or other forms of those polymers or blends of those polymers. For example, a polyethylene may comprise a low density polyethylene, a linear low density polyethylene, a medium density polyethylene, a high density polyethylene, or copolymers where ethylene is a major component. Furthermore, such polyethylene polymers may be made with Ziegler-Natta, metallocene, or other catalytic systems or other processes. In certain embodiments of the invention, for example, the polypropylene may comprise a polypropylene homopolymer and a polypropylene copolymer. In accordance with certain embodiments of the invention, the polypropylene may comprise a form comprising an isotactic form, a syndiotactic form, or an atactic form. The polypropylene may comprise polypropylenes made with Ziegler-Natta or metallocene catalyst systems or any other suitable process.

In accordance with certain embodiments of the invention, the continuous fibers may comprise from about 3% to about 30% by weight of the nonwoven fabric, such as at most about any of the following: 30, 25, 20, 18, 15, 12, and 10% by weight of the nonwoven fabric and/or at least about any of the following: 3, 5, 7, 9, 10, 12, and 15% by weight of the nonwoven fabric. In accordance with certain embodiments of the invention, the continuous fibers (e.g., spunbond fibers) may provide dimensional stability (e.g., strength), such as on an attachment side of the nonwoven fabric, to the nonwoven fabric while still having flexibility and softness on the cleaning or floor engaging side or surface of the nonwoven fabric. In this regard, the nonwoven fabric may comprise a first surface (e.g., an attachment side of the nonwoven fabric) and a second surface (e.g., a cleaning surface or floor engaging surface) being opposite the first surface, in which a first quantity of the continuous fibers is located at the first surface and a second and different quantity of the continuous fibbers is located at the second surface. In accordance with certain embodiments of the invention, the first quantity (e.g., at the attachment side of the nonwoven fabric that engages a cleaning implement) is greater than the second quantity (e.g., the cleaning surface or floor engaging surface). In accordance with such embodiments, for instance, the amount or quantity of continuous fibers present in the nonwoven fabric is not uniform throughout the thickness (e.g., a z-direction being perpendicular to a plane defined by a cross-direction and a machine direction of the nonwoven fabric) of the nonwoven fabric. By having a greater percentage of the continuous fibers located at or proximate to the attachment side/surface of the nonwoven fabric, in accordance with certain embodiments of the invention, the dimensional stability/strength can be increased without negatively impacting the flexibility and/or softness of the cleaning or floor engaging surface of the nonwoven fabric. The first quantity, in accordance with certain embodiments of the invention, may comprise from at least about 1.5 times more continuous fibers than the second quantity, such as at most about any of the following: 10, 9, 8, 7, 6, 5, and 3 times more continuous fibers than the second quantity and/or at least about any of the following: 1.5, 2, 2.5, 3, 3.5, and 5 times more continuous fibers than the second quantity. In accordance with certain embodiments of the invention, the floor engaging surface of the nonwoven fabric may be devoid or substantially devoid of any continuous fibers. In this regard, the mechanical entanglement of the (i) continuous fibers and (ii) the blend of staple fibers may be such that none or substantially none of the continuous fibers extend completely through the z-direction of the nonwoven fabric.

The nonwoven fabric, in accordance with certain embodiments of the invention, comprises a blend of staple fibers (e.g., the aggregate of polyester staple fibers, bicomponent staple fibers, microfiber staple fibers, and wettable staple fibers) that may comprise from about 70% to about 97% by weight of the nonwoven fabric, such as at most about any of the following: 97, 95, 93, 91, 90, 88, and 85% by weight of the nonwoven fabric and/or at least about any of the following: 70, 75, 80, 82, 85, 88, and 90% by weight of the nonwoven fabric.

In accordance with certain embodiments of the invention, the polyester staple fibers may comprise from about 10% to about 40% by weight of the nonwoven fabric, such as at most about any of the following: 40, 38, 36, 34, 32, 30, 28, 26, 24, 22, 20, and 18% by weight of the nonwoven fabric and/or at least about any of the following: 10, 12, 14, 16, 18, 20, 22, and 24% by weight of the nonwoven fabric. In accordance with certain embodiments of the invention, the polymeric composition of the polyester staple fibers may comprise at least about 70% by weight of one or more polyester polymers and optionally a second polymer, such as at least about 75%, 80%, 85%, 90%, 99%, and 99% by weight of one or more polyester polymers. In accordance with certain embodiments of the invention, the polymeric composition of the polyester staple fibers comprise 100% by weight of one or more polyester polymers. In accordance with certain embodiments of the invention, the polyester staple fibers may impart improved surface sliding properties to the nonwoven fabric as well as an improved application or deposition of liquid cleaning chemicals to a surface to be cleaned as the polyester staple fibers may release the liquid cleaning chemicals faster. In accordance with certain embodiments of the invention, the polyester staple fibers are devoid of any hydrophilic modification, such as a hydrophilic coating thereon. In this regard, the polyester staple fibers may be generally hydrophobic in nature.

In accordance with certain embodiments of the invention, the polymeric composition of the polyester staple fibers may include one or more polyester polymers including, for example, polyesters of aromatic dicarboxylic acids with aliphatic diols, such as polyalkylene terephthalates, for example, polyethylene terephthalate, polytrimethylene terephthalate and polybutylene terephthalate and polyalkylene naphthalates, for example, polyethylene naphthalates; polyesters of cycloaliphalic dicarboxylic acids with aliphatic diols, for example, polyalkylene cyclohexane-dicarboxylates; polyesters of aromatic dicarboxylic acids with cycloaliphatic diols, for example, polycyclohexanedimethanol terephthalate; polyesters of aliphatic dicarboxylic acids with aliphatic diols, for example, polyethylene succinate, polybutylene succinate, polyethylene adipate and polybutylene adipate; and polyhydroxycarboxylate esters, for example, polylactate esters and polyhydroxybenzoate esters. In accordance with certain embodiments of the invention, suitable polyesters may comprise copolyesters containing at least one copolymerizing component selected from acid components, for example, isophthalic acid, phthalic acid, adipic acid, sebacic acid, α,β-(4-carboxyphenoxy)ethane, 4,4-dicarboxyphenyl, 5-sodium sulfoisophthatic acid, 2,6-naphthalene dicarboxylic acid and 1,4-cyclohexanedicarboxylic acid and esters of the above-mentioned acids, and diol components, for example, diethylene glycol, 1,3-propanediol, 1,4-butanediol, 1,6-hexanediol, neopentyl glycol, 1,4-cyclohexane dimethanol and polyalkylene glycol. The copolymerizing component, for example, may be selected from compounds having three or more carboxylic acid groups or hydroxyl groups, for example, pentaerythritol, trimethylolpropane, trimellitic acid, and trimesic acid, to cause the resultant copolyesters have branched chains. In accordance with certain embodiments of the invention, for example, the above-mentioned polyester polymers (copolymers) may be employed alone or in a mixture of two or more thereof.

In accordance with certain embodiments of the invention, the bicomponent staple fibers may comprise from about 10% to about 40% by weight of the nonwoven fabric, such as at most about any of the following: 40, 38, 36, 34, 32, 30, 28, 26, 24, 22, 20, and 18% by weight of the nonwoven fabric and/or at least about any of the following: 10, 12, 14, 16, 18, 20, 22, and 24% by weight of the nonwoven fabric. The bicomponent staple fibers, for example, may comprise a sheath/core configuration, a side-by-side configuration, a pie configuration, an islands-in-the-sea configuration, a multi-lobed configuration, or any combinations thereof. In accordance with certain embodiments of the invention, the sheath/core configuration may comprises an eccentric sheath/core configuration including a sheath components and core component that is not concentrically located within the sheath component. The core component, for example, may define at least a portion of an outer surface of the bicomponent fiber having the eccentric sheath/core configuration in accordance with certain embodiments of the invention.

In accordance with certain embodiments of the invention, the bicomponent staple fibers may comprise a first component comprising a first polymeric composition and a second component comprising a second polymeric composition, in which the first polymeric composition is different than the second polymeric composition. For example, the first polymeric composition may comprise a first polyolefin composition and the second polymeric composition may comprise a second polyolefin composition. In accordance with certain embodiments of the invention, the first polyolefin composition may comprise a first polypropylene and/or a first polyethylene and the second polyolefin composition comprises a second polypropylene and/or a second polyethylene, in which the first polypropylene and/or a first polyethylene has, for example, a lower degree of crystallinity than the second polypropylene and/or a second polyethylene.

In accordance with certain embodiments of the invention, the bicomponent staple fibers may comprise one or more crimps therein, wherein the crimp(s) increase the loft of the nonwoven fabric. In accordance with certain embodiments of the invention, the first polymeric composition and the second polymeric composition can be selected so that the bicomponent staple fibers develop one or more crimps with or without the application of heat and/or post-treatments such as after fiber lay down and web formation. The polymeric compositions, therefore, may comprise polymers that are different from one another in that they have disparate stress or elastic recovery properties, crystallization rates, and/or melt viscosities. In accordance with certain embodiments of the invention, bicomponent staple fibers, for example, can form or have crimped fiber portions that impart loft to the nonwoven fabric. Additionally or alternatively, the bicomponent staple fibers may be mechanically crimped.

The bicomponent staple fibers, in accordance with certain embodiments of the invention, may facilitate perception and/or actual three-dimensional effect and textile-feel (e.g., increase in stiffness).

The nonwoven fabric, in accordance with certain embodiments of the invention, may comprise microfiber staple fibers that comprise from about 10% to about 40% by weight of the nonwoven fabric, such as at most about any of the following: 40, 38, 36, 34, 32, 30, 28, 26, 24, 22, 20, and 18% by weight of the nonwoven fabric and/or at least about any of the following: 10, 12, 14, 16, 18, 20, 22, and 24% by weight of the nonwoven fabric.

In accordance with certain embodiments of the invention, the microfiber staple fibers may comprise very fine fibers in comparison to more conventional fiber forms with their small size resulting in unique and desirable properties (e.g., high surface area associated with the presence of micro-pores and/or micro-channels) relative to conventional fibers, whether natural or synthetic, as discussed above. In accordance with certain embodiments of the invention, pre-split and/or non-split portions of the microfiber staple fibers may comprise a dtex value from 1 to about 5 dtex, such as at most about any of the following: 5, 4.5, 4.0, 3.5, 3, 2.8, 2.6, 2.4, 2.2, 2.0, 1.8, and 1.6 dtex and/or at least about any of the following: 1, 1.2, 1.4, 1.6, 1.8, 2.0, and 2.2 dtex. In accordance with certain embodiments of the invention, split portions of the microfiber staple fibers may comprise a dtex value of less than about 1 dtex, such as at most about any of the following: 1, 0.9, 0.8, 0.7, 0.6, 0.5, 0.4, 0.3, 0.2, 0.15, 0.1, and 0.08 dtex and/or at least about any of the following: 0.05, 0.06, 0.07, 0.08, 0.09, 0.1, 0.11, 0.12, 0.13, 0.14, and 0.15 dtex.

The microfiber staple fibers tend to have and/or develop a positive charge that attracts and/or retains dust and small particles. The microfiber staple fibers, in accordance with certain embodiments of the invention, may comprise a synthetic polymer. The synthetic polymer, for example, may comprises a polyolefin, a polyester, a polyamide, or any combination thereof. By way of example only, the synthetic polymer may comprises at least one of a polyethylene, a polypropylene, a partially aromatic or fully aromatic polyester, an aromatic or partially aromatic polyamide, an aliphatic polyamide, or any combination thereof. In accordance with certain embodiments of the invention, the microfiber staple fibers may comprise a blend of a polyester and a polyamide (e.g., nylon). In embodiments in which the microfiber staple fibers comprise a polyester, the polyester microfiber staple fibers may be distinguished from the previously discussed polyester staple fibers by dtex and/or presence of micro-pores and/or micro-channels present in the microfibers. For instance, the previously discussed polyester staple fibers may comprise a dtex greater than that of the polyester microfiber staple fibers by at least 10%, 20%, 40%, 50%, 75%, 100%, 150%, etc.

In accordance with certain embodiments of the invention, the wettable staple fibers comprise from about 10% to about 40% by weight of the nonwoven fabric, such as at most about any of the following: 40, 38, 36, 34, 32, 30, 28, 26, 24, 22, 20, and 18% by weight of the nonwoven fabric and/or at least about any of the following: 10, 12, 14, 16, 18, 20, 22, 24, and 25% by weight of the nonwoven fabric. The wettable staple fibers may comprise cellulosic fibers comprising natural cellulose, synthetic cellulose, or a combination thereof. In accordance with certain embodiments of the invention, the cellulosic fibers may comprise viscose. Additionally or alternatively, the wettable staple fibers may comprise hydrophilic-modified polyester staple fibers. For example, the hydrophilic-modified polyester staple fibers may comprise a hydrophilic finish coated thereon. In accordance with certain embodiments of the invention, the wettable staple fibers comprising hydrophilic-modified polyester staple fibers are different from the other polyester staple fibers of the nonwoven fabric, which are devoid of any hydrophilic modification (e.g., devoid of a hydrophilic finished coating thereon) and may be generally hydrophobic in nature. Hydrophilic-modified polyester staple fibers are commercially available from DAK Americas LLC under the trade name Delcron® Hydrotec Fiber. In accordance with certain embodiments of the invention, the wettable staple fibers may be devoid of viscose fibers (e.g., 100% of other cellulose staple fibers, 100% hydrophilic-modified polyester staple fibers, or a combination of hydrophilic-modified polyester staple fibers and non-viscose cellulose staple fibers). In accordance with certain embodiments of the invention, the nonwoven fabric may be devoid of viscose fibers (e.g., viscose staple fibers).

The blend of staple fibers, in accordance with certain embodiments of the invention, may comprise a component weight ratio between the polyester staple fibers, the bicomponent staple fibers, the microfiber staple fibers, and the wettable staple fibers according to the formula A:B:C:D, wherein (i) 'A' is the weight percent of the polyester staple fibers based on a total weight of the blend of staple fibers and comprises a value from about 0.75 to about 1.25, such as at most about any of the following: 1.25, 1.2, 1.5, 1.1, 1, 0.9, and 0.8 and/or at least about any of the following: 0.75, 0.8, 0.85, 0.9, 0.95, 1.0, and 1.1; (ii) 'B' is the weight percent of the bicomponent staple fibers based on a total weight of the blend of staple fibers and comprises a value from about 0.75 to about 1.25, such as at most about any of the following: 1.25, 1.2, 1.5, 1.1, 1, 0.9, and 0.8 and/or at least about any of the following: 0.75, 0.8, 0.85, 0.9, 0.95, 1.0, and 1.1; (iii) 'C' is the weight percent of the microfiber staple fibers based on a total weight of the blend of staple fibers and comprises a value from about 0.75 to about 1.25, such as at most about any of the following: 1.25, 1.2, 1.5, 1.1, 1, 0.9, and 0.8 and/or at least about any of the following: 0.75, 0.8, 0.85, 0.9, 0.95, 1.0, and 1.1; and (iv) 'D' is the weight percent of the wettable staple fibers based on a total weight of the blend of staple fibers and comprises a value from about 0.75 to about 1.25, such as at most about any of the following: 1.25, 1.2, 1.5, 1.1, 1, 0.9, and 0.8 and/or at least about any of the following: 0.75, 0.8, 0.85, 0.9, 0.95, 1.0, and 1.1. In accordance with certain embodiments of the invention, the component weight ratio may comprise about 0.9-1.1:0.9-1.1:0.9-1.1:0.9-1.1 or 1:1:1:1.

The nonwoven fabric, in accordance with certain embodiments of the invention, may comprise a three-dimensional pattern on at least one surface (e.g., a cleaning or floor engaging surface) of the nonwoven fabric. The three-dimensional pattern, for example, may comprise a plurality of recessed portions configured to facilitate the capture of loose debris, in which the recessed portion extend in the z-direction (e.g., the z-direction being perpendicular to a plane defined by a cross-direction and a machine direction of the nonwoven fabric) of the nonwoven fabric. In accordance with certain embodiments of the invention, the plurality of recessed portions comprise an average depth from about, for example, from about 1.5 mm to about 3 mm, such as at most about any of the following: 3.0, 2.9, 2.8, 2.7, 2.6, 2.5, 2.4, 2.3, 2.2, 2.1, and 2.0 mm and/or at least about any of the following: 1.0, 1.1, 1.2, 1.3, 1.4, 1.5, 1.6, 1.7, 1.8, 1.9, and 2.0 mm. In accordance with certain embodiments of the invention, the average width (e.g., shortest dimension perpendicular to the z-direction of the nonwoven fabric) of the plurality of recessed portions may comprise from about 0.25 mm to about 1.8 mm, such as at most about any of the following: 1.8, 1.7, 1.6, 1.5, 1.4, 1.3, 1.2, 1.1, 1.0, 0.9, and 0.8 mm and/or at least about any of the following: 0.3, 0.4, 0.5, 0.6, 0.7, 0.8, 0.9, 1.0, 1.1, 1.2, and 1.3 mm. In accordance with certain embodiments of the invention, the average length (e.g., longest dimension perpendicular to the z-direction of the nonwoven fabric) of the plurality of the recessed portions by extend continuously along the entire length of the nonwoven fabric (e.g., either in the machine direction or the cross-direction) or at least be from about 2 times, 3 times, 5 times, 10 times, 20 times, 50 times, or 100 times the average width of the plurality of recessed portions. In accordance with certain embodiments of the invention, the plurality of recessed portions may be separated by individual ridges (e.g., alternating ridges and recessed portions). The individual ridges, for example, may have an average ridge-width from about 1.5 mm to about 4.0 mm, such as at most about any of the following: 4.0, 3.8, 3.6, 3.4, 3.2, 3.0, 2.9, 2.8, 2.7, 2.6, 2.5, 2.4, 2.3, 2.2, 2.1, and 2.0 mm and/or at least about any of the following: 1.5, 1.6, 1.7, 1.8, 1.9, and 2.0 mm.

In accordance with certain embodiments of the invention, the nonwoven fabric may comprise a first ratio of the average depth of the plurality of recessed portions to the average width of the plurality of recessed portions comprising from about 5:1 to about 1.5:1, such as at most about any of the following: 5, 4.8, 4.6, 4.4, 4.2, 4.0, 3.8, 3.6, 3.4, 3.2, 3.0, 2.8, 2.6, 2.4, 2.2, and 2.0 and/or at least about any of the following: 1.5, 1.6, 1.7, 1.8, 1.9, 2.0, 2.1, 2.2, 2.3, 2.4, and 2.5. Additionally or alternatively, the nonwoven fabric may comprise a second ratio of the ridge width of the plurality of ridges to the average width of the plurality of recessed portions comprising from about 5:1 to about 1.5:1, such as at most about any of the following: 5, 4.8, 4.6, 4.4, 4.2, 4.0, 3.8, 3.6, 3.4, 3.2, 3.0, 2.8, 2.6, 2.4, 2.2, and 2.0 and/or at least about any of the following: 1.5, 1.6, 1.7, 1.8, 1.9, 2.0, 2.1, 2.2, 2.3, 2.4, and 2.5.

In accordance with certain embodiments of the invention, the plurality of recessed portions may account for a recessed top plan area from about 20% to about 50% of the total top plan area of the nonwoven fabric, such as at most about any of the following: 50, 45, 40, 35, 30, 25, and 20% of the total top plan area of the nonwoven fabric and/or at least about any of the following: 10, 12, 14, 16, 18, 20, 22, 24, and 26% of the total top plan area of the nonwoven fabric. In this regard, a top plan view is an orthographic projection of a 3-dimensional object (e.g., the nonwoven fabric described and disclosed herein) from the position of a horizontal plane through the object. As used herein, for example, the recessed top plan area comprises the 2-D area of the total top plan area that is occupied or accounted for by the plurality of recessed portions.

Figure 2A:
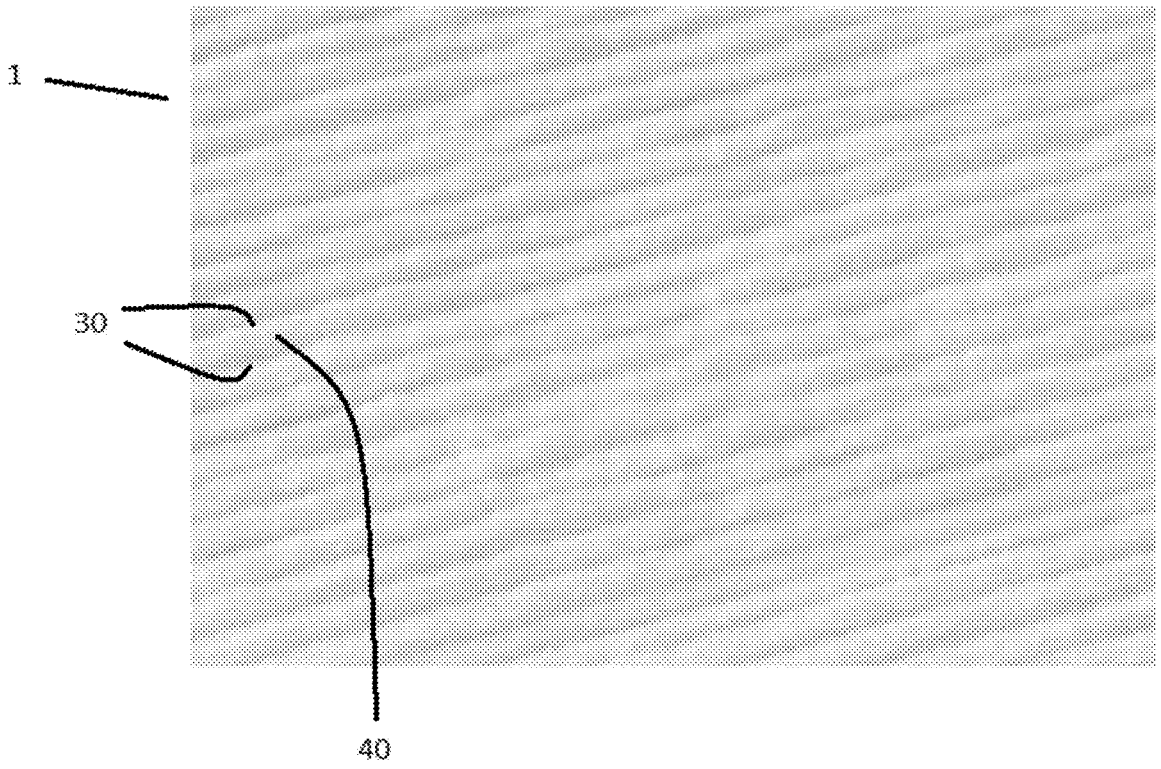
FIG. 2A is an image of nonwoven fabric having a three-dimensional floor engaging surface including a plurality of recessed in accordance with certain embodiments of the invention.
Figure 2B:
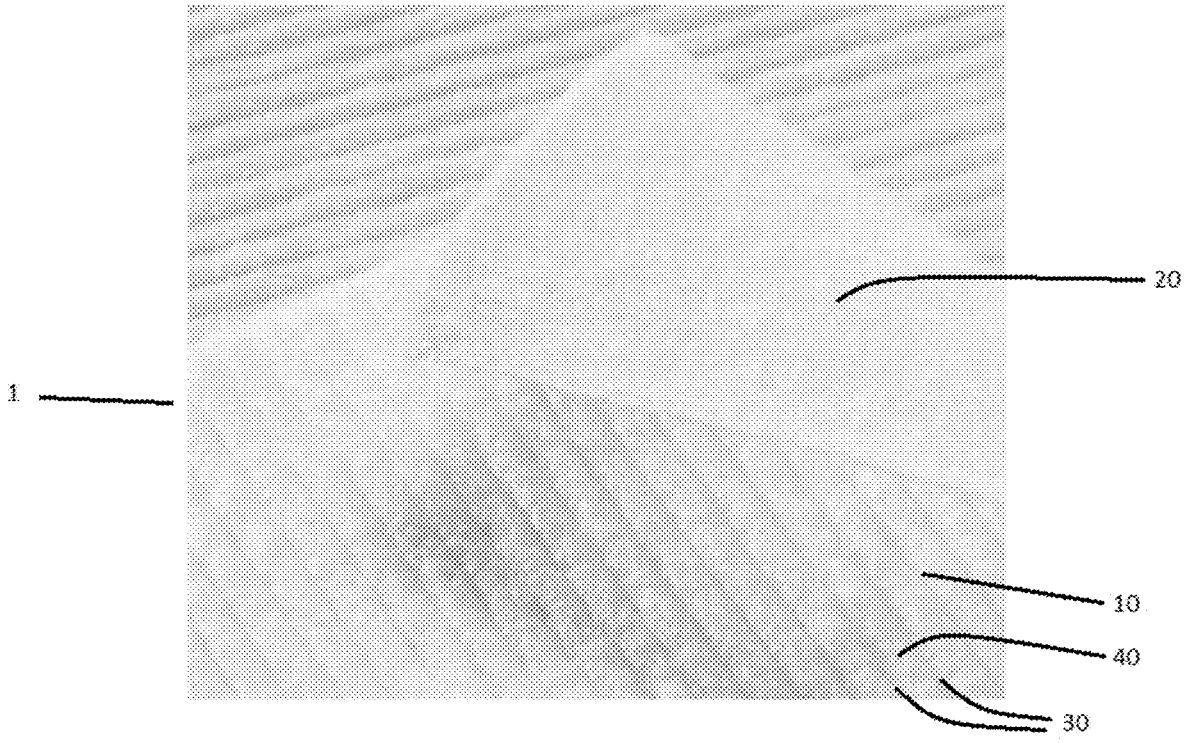
FIG. 2B is an image of nonwoven fabric of FIG. 2A, in which the rear/attachment surface is shown adjacent to the floor engaging surface.
Figure 2C:
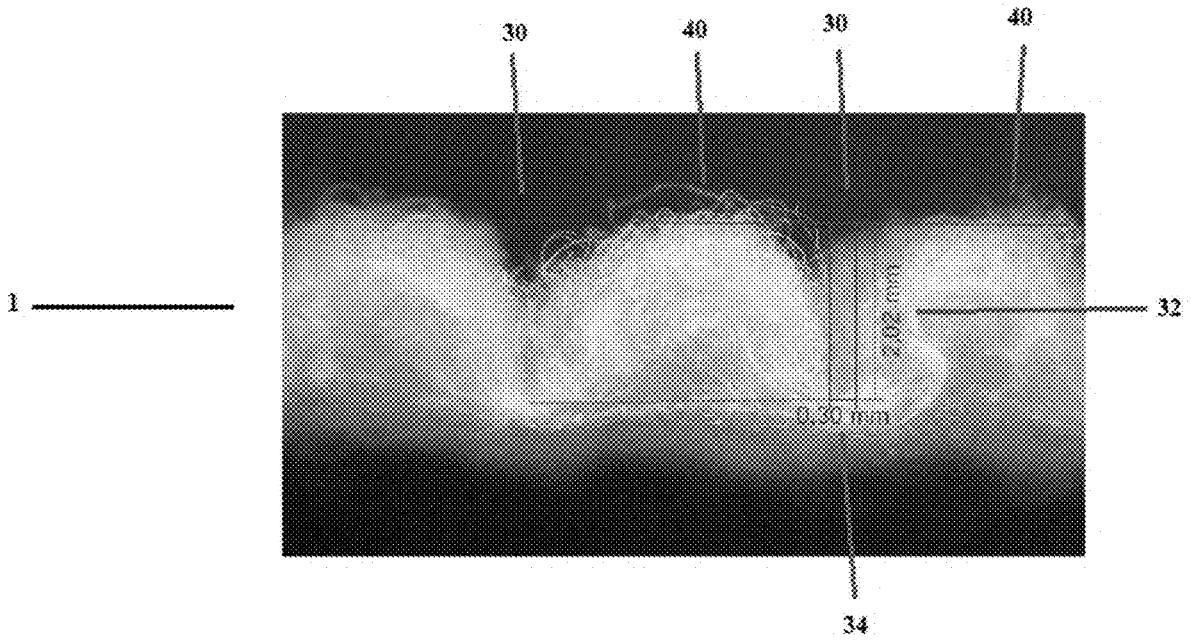
FIG. 2C is side-view image of a nonwoven fabric showing a measurement of a recessed portion's depth 32 and the recessed portion's width in accordance with certain embodiments of the invention.
Figure 2D:
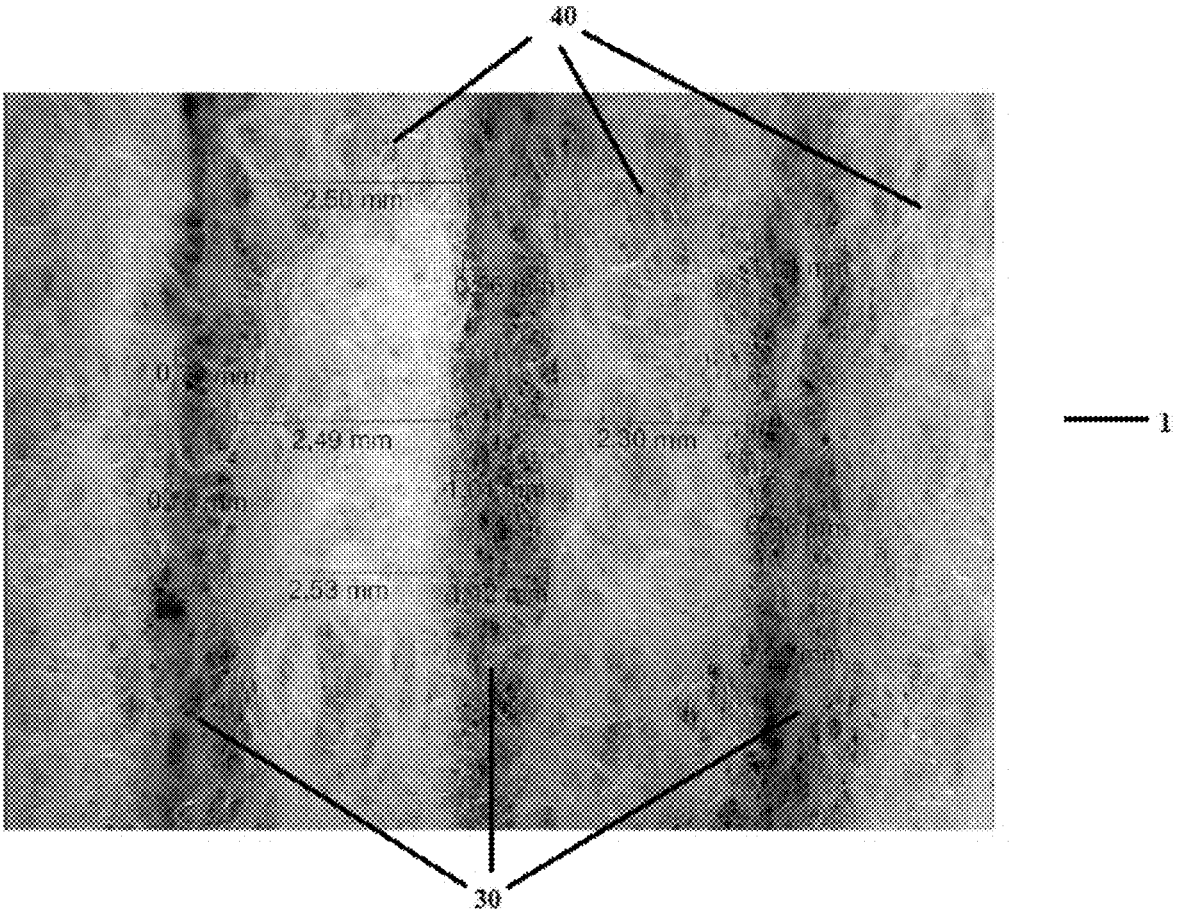
FIG. 2D is a top view of a nonwoven fabric illustrating the relative widths of the plurality of recessed portions and the plurality of ridges in accordance with certain embodiments of the invention.

The plurality of recessed portions, in accordance with certain embodiments of the invention, may comprise a plurality of individual recessed portions being separate and distinct from each other, such as a series of alternating ridges and recessed portions. FIG. 2A, for example, is an image of nonwoven fabric 1 including a three-dimensional floor engaging surface including a plurality of recesses or recessed portions 30. The nonwoven fabric shown in FIG. 2A includes a repeating series of alternating ridges 40 and recessed portions 30 in accordance with certain embodiments of the invention. FIG. 2B is an image of nonwoven fabric of FIG. 2A, in which the rear/attachment surface 20 is shown adjacent to the floor engaging surface 10. As illustrated in FIG. 2B the rear/attachment surface 20 of this particular nonwoven fabric has a generally flat or planar geometry in relation to that of the floor engaging surface 10. FIG. 2C is side-view image of a nonwoven fabric 1 showing a measurement of a recessed portion's 30 depth 32 (i.e., 2.02 mm) and the recessed portion's width 34 (i.e., 0.3 mm). FIG. 2D is a top view of a nonwoven fabric 1 illustrating the relative widths of the plurality of recessed portions 30 and the plurality of ridges 40.

In accordance with certain embodiments of the invention, the nonwoven fabric comprises a cleaning ability to dust and/or disinfect (e.g., if treated with a cleaning composition)

from about 75 to about 125 $m^2$ (e.g., about 75 to about 125 $m^2$) of a surface with a cleaning surface of the nonwoven fabric, wherein the cleaning surface comprises a macroscopic area, for example, from about 559 cm' (e.g., 43 cm×13 cm sized nonwoven fabric attached to a mop frame) to about 793 $cm^2$ (e.g., 61 cm×13 cm sized nonwoven fabric attached to a mop frame). In this regard, the cleaning ability of the nonwoven fabric may be evaluated by visually evaluating the area ($m^2$) in which the surface being cleaned (e.g., a floor) remains wetted by the nonwoven fabric when performing a wet-mopping operation and/or whether the nonwoven fabric continues to remove dirt and/or debris. In accordance with certain embodiments of the invention, for instance, the macroscopic area comprises the value of the length of the nonwoven fabric multiplied by the width of the nonwoven fabric. In this regard, the macroscopic area is not the same as the true surface area of the nonwoven fabric, which accounts for the three-dimensional surface defined by the recessed portions and/or ridges. In accordance with certain embodiments of the invention, the nonwoven fabric comprises a cleaning ability to dust and/or disinfect (e.g., if treated with a cleaning composition) an area of at least about 900 $m^2$ per 1 $m^2$ of the nonwoven fabric as determined by the ratio between the surface area cleaned to the macroscopic area of the nonwoven fabric used in the cleaning operation (e.g., dusting, wet-mopping, etc.). The nonwoven fabric comprises a cleaning ability to dust and/or disinfect (e.g., if treated with a cleaning composition), for example, an area of at most about any of the following: 3000, 2800, 2600, 2400, 2200, 2000, 1800, 1600, 1400, and 1200 $m^2$ per 1 $m^2$ of the nonwoven fabric as determined by the ratio between the surface area cleaned to the macroscopic area of the nonwoven fabric and/or at least about any of the following: 900, 950, 1000, 1050, 1100, 1150, 1200, 1250, 1300, 1350, 1400, 1450, and 1500 $m^2$ per 1 $m^2$ of the nonwoven fabric as determined by the ratio between the surface area cleaned to the macroscopic area of the nonwoven fabric. In accordance with certain embodiments of the invention, the nonwoven fabric exhibiting a cleaning ability as disclosed herein may comprise a basis weight from about 25 gsm to about 200 gsm, such as about at most about any of the following: 200, 175, 150, 125, 100, and 75 gsm and/or at least about any of the following: 25, 40, 50, 60, 70, 80, 90, 100, and 125 gsm.

In accordance with certain embodiments of the invention, the nonwoven fabric may be provided in a form of individual wipes disposed within a package. For example, the individual wipes may be disposed within a pre-packaged container for dispensing of the individual wipes one at a time.

In another aspect, the present invention provides a cleaning system comprising a cleaning implement including a mop frame and a nonwoven fabric as described and disclosed herein. In accordance with certain embodiments of the invention, the nonwoven fabric may directly or indirectly attached to the mop frame. For example, the nonwoven fabric may be releasably engaged by the mop frame. The cleaning implement, in accordance with certain embodiments of the invention, may also comprise a handle directly or indirectly attached to the mop frame. The cleaning implement, in accordance with certain embodiments of the invention, may further comprise a liquid reservoir configured to contain a liquid cleaning composition. In accordance with certain embodiments of the invention, the liquid reservoir may be mounted directly or indirectly onto the handle. The cleaning implement, in accordance with certain embodiments of the invention, may further comprise a spraying mechanism configured to controllably dispense the liquid housed within the liquid reservoir.

Figure 3:
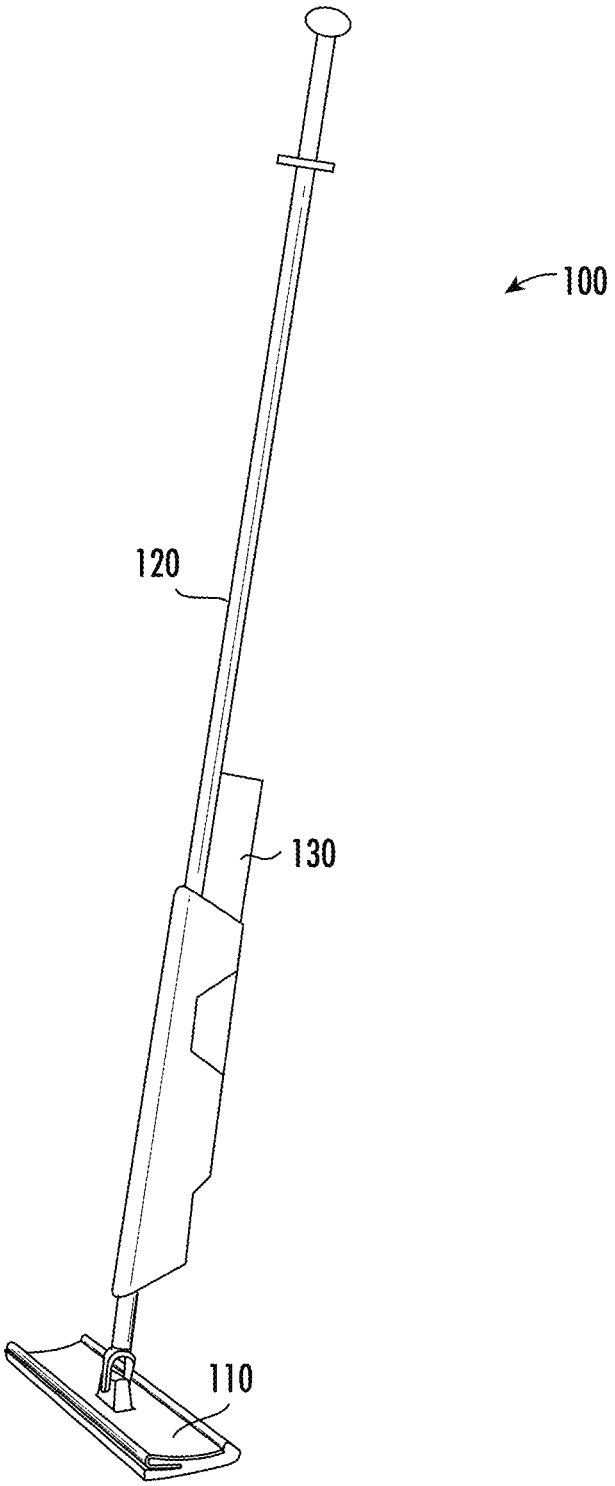
FIG. 3 illustrates a cleaning implement in accordance with certain embodiments of the invention.

FIG. 3 illustrate a cleaning implement 100 in accordance with certain embodiments of the invention, in which the cleaning implement includes a mop frame 110 and a handle 120 connected to the mop frame. The cleaning implement 100 shown in FIG. 3 also includes a liquid reservoir 130 mounted on the handle 120 of the cleaning implement.

Figure 4:
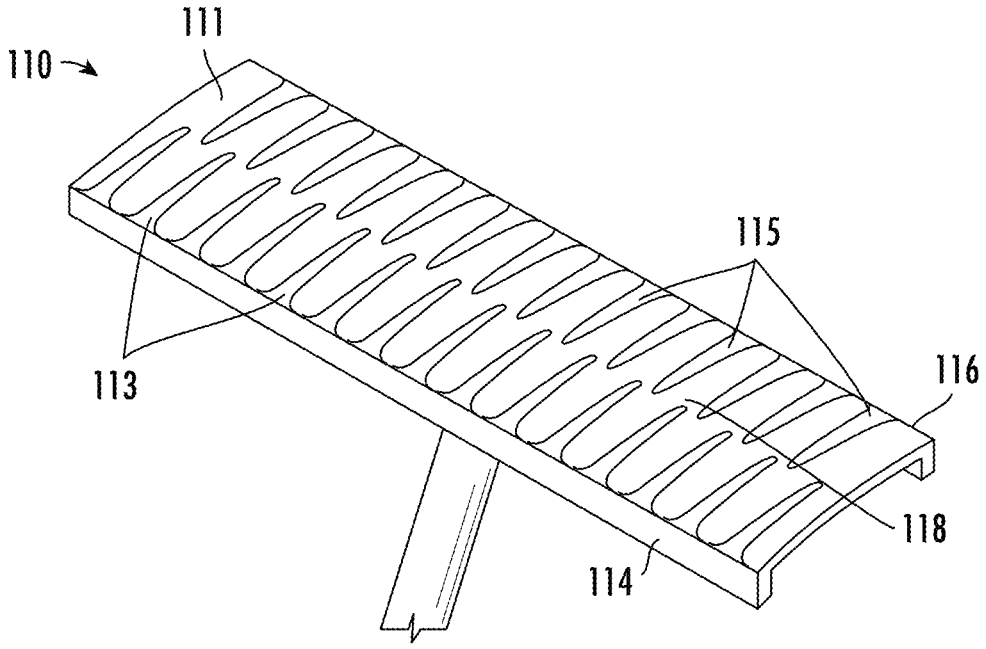
FIG. 4 illustrates the underside or floor engaging portion of a mop frame in accordance with certain embodiments of the invention.

FIG. 4 illustrates the underside or floor engaging portion 111 of a mop frame 110 in accordance with certain embodiments of the invention. The mop frame may optionally include a plurality of separate and distinct frontal recessed portions 113 and/or a plurality of separate and distinct rearward recessed portions 115. For example, the plurality of separate and distinct frontal recessed portions 113 extend from a front edge 114 of the mop frame 110 towards and terminates at or proximate to a central body portion 118 of the mop frame. In accordance with certain embodiments of the invention, the plurality of separate and distinct rearward recessed portions 115 extend from a rear edge 116 of the mop frame 110 towards and terminates at or proximate to a central body portion 118 of the mop frame. In accordance with certain embodiments of the invention, the frontal recessed portions and/or rearward recessed portions may each independently be defined by corresponding deep-set (or recessed) portions formed in the front edge and bottom surface to form hollow or tunnel-like portions in the mop frame. For instance, the frontal recessed portions and/or rearward recessed portions may also, according to certain embodiments of the invention, be described as "cut-out" portions of the mop frame in which material has been removed from the mop frame to provide hollow or tunnel-like portions or structures in the mop frame that may terminate at or near the central body portion of the mop frame. In accordance with certain embodiments of the invention, for example, the frontal recessed portions and/or rearward recessed portions may comprise a top wall and at least one side wall. In accordance with certain embodiments of the invention, the mop frame may be devoid of the previously described recessed portions.

Figure 5A:
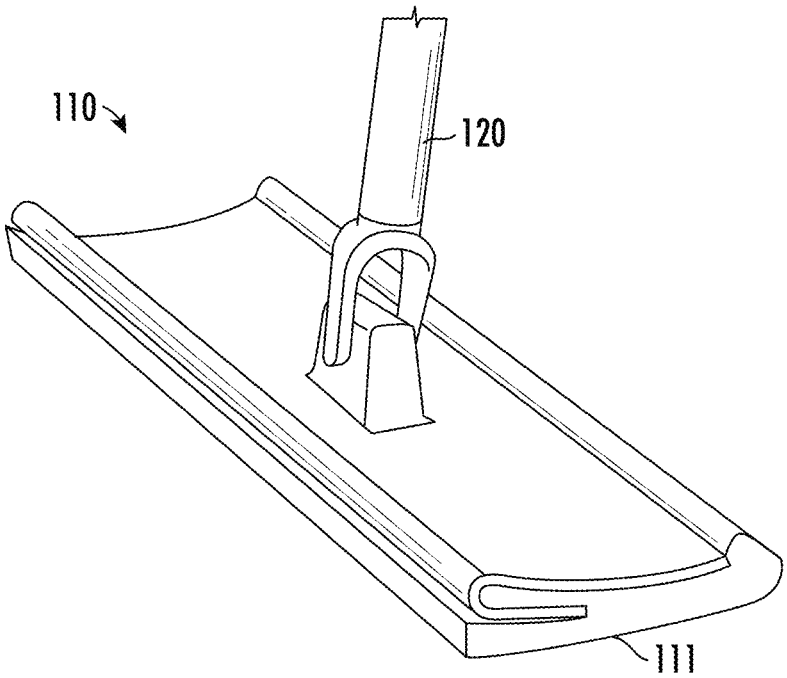
FIG. 5A illustrates a mop frame in accordance with certain embodiments of the invention.
Figure 5B:
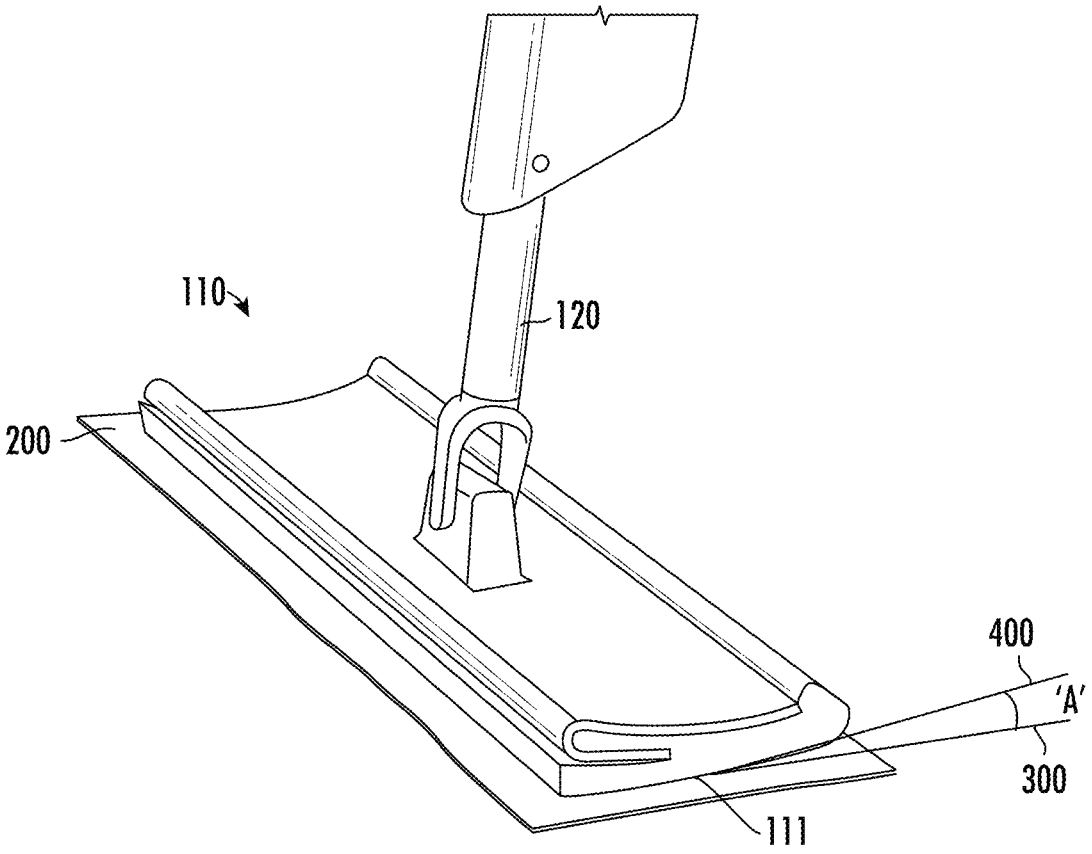
FIG. 5B illustrates the mop frame of FIG. 5A, in which the mop frame has a nonwoven fabric attached thereto via a hook-and-loop fastening system.

In accordance with certain embodiments of the invention, the mop frame may comprise a floor engaging surface in which at least a portion thereof comprises a fastening means including a hook-and-loop fastening configuration of system (e.g., Velcro®). For example, from about 10% to about 100% of the surface area of the floor engaging surface of the mop frame may comprise hooks (e.g., male-portions of a hook-and-loop fastening system) configured to mechanically engage the nonwoven fabric and releasably attach the nonwoven fabric to the mop frame. In accordance with certain embodiments of the invention, a nonwoven fabric, such as those disclosed herein, may be attached to the floor engaging surface of the mop frame by simply placing the floor engaging surface of the mop frame onto and/or over the nonwoven fabric and applying pressure such that the hooks mechanically engage the nonwoven fabric. Once removal or disposal of the nonwoven fabric is desired, the nonwoven fabric can be simply peeled off or apart from the floor engaging surface of the mop frame. FIG. 5A illustrates a top-perspective view of a mop frame 110 attached to a handle 120, in which the underside or floor engaging surface 111 includes a fastening means comprising the male-portion of a hook-and-loop fastening configuration of system. FIG. 5B illustrates the mop frame of FIG. 5A, in which a nonwoven fabric 200 is releasably attached to the floor engaging surface 111 of the mop frame 110 via a plurality of hooks (e.g., male-portions of a hook-and-loop fastening system), which are not shown, that are mechanically engaged and attached to with the nonwoven fabric 200.

In accordance with certain embodiments of the invention, the underside or floor engaging surface of the mop frame may be substantially planar or flat (e.g., defined by a single imaginary plane). For example, the entirety of the floor engaging surface of the mop may be flat (e.g., defined by a single imaginary plane). In accordance with certain embodiments of the invention, the underside or floor engaging surface of the mop frame may not be generally flat or planar. For example, the floor engaging surface of the mop may have an angle 'A' as illustrated in FIG. 5B defined as the angle formed between (i) a first imaginary plane 300 including a generally flat portion (e.g., near the center of the mop frame) of the underside or floor engaging surface of the mop frame and (ii) a second imaginary plane 400 including at least one angled portion of the underside or floor engaging surface of the mop frame that diverges away from the first imaginary plane. In accordance with certain embodiments of the invention, the angle 'A' may comprise at most about any of the following: 60, 45, 30, 25, 20, 15, 10, 9, 8, 7, 6, 5, 4, 3.5, 3, and 2.5 degrees and/or at least about any of the following: 1, 1.5, 2, 2.5, 3, 3.5, 4, 4.5, and 5 degrees.

In another aspect, the present invention provides a method of forming a nonwoven fabric comprising forming or providing a web of continuous fibers having a top surface and forming or providing a carded web comprising a blend of staple fibers including polyester staple fibers, bicomponent staple fibers, microfiber staple fibers, and wettable staple fibers. The method may further comprise positioning the carded web directly or indirectly onto the top surface of the web of continuous filaments followed by mechanically entangling (e.g., hydroentangled, needle-punched, air-entangled, etc.) the carded web with the continuous fibers to define a nonwoven fabric (e.g., a hydroentangled nonwoven fabric) as described and disclosed herein. In accordance with certain embodiments of the invention, the web of continuous fibers may comprise spunbond fibers either in a freely laid and non-bonded/consolidated state or as a pre-bonded/consolidated state (e.g., pre-bonded spunbond nonwoven fabric consolidated by thermal bonding). In accordance with certain embodiments of the invention, the method may further comprise melt-spinning the continuous filaments.

In accordance with certain embodiments of the invention, the method may further comprise imparting a three-dimensional image onto or in at least one surface of the nonwoven fabric. The method, for example, may comprise positioning a second surface of the nonwoven fabric (e.g., a cleaning or floor engaging side or surface) directly or indirectly onto an image transfer device having a three-dimensional pattern and applying jets of fluid directly or indirectly to a first surface of the nonwoven fabric (e.g., attachment side or surface of the nonwoven fabric) to impart a three-dimensional pattern onto the nonwoven fabric. For example, according to certain embodiments of the invention, the image transfer device may comprise one or more drums or even one or more sleeves affixed to a corresponding drum. One or more water jets, for example, high pressure water jets according to certain embodiments of the invention, may be applied to a side of the nonwoven opposite to the side contacting the image transfer device. Without intending to be bound by the theory, the one or more water jets and water directed through the nonwoven fabric causes the fibers (e.g., the continuous fibers and the blend of staple fibers) of the nonwoven fabric to become displaced according to the image on the image transfer device such as the image formed on one or more drums or one or more sleeves affixed to a corresponding drum causing a three-dimensional pattern to be imaged throughout the nonwoven fabric according to such image. Such imaging techniques are further described in, for example, U.S. Pat. No. 6,314,627 entitled "Hydroentangled Fabric having Structured Surfaces"; U.S. Pat. No. 6,735,833 entitled "Nonwoven Fabrics having a Durable Three-Dimensional Image"; U.S. Pat. No. 6,903,034 entitled "Hydroentanglement of Continuous Polymer Filaments"; U.S. Pat. No. 7,091,140 entitled "Hydroentanglement of Continuous Polymer Filaments"; and U.S. Pat. No. 7,406,755 entitled "Hydroentanglement of Continuous Polymer Filaments", each of which are included in their entirety herein by reference. In accordance with certain embodiments of the invention, the three-dimensional pattern, for example, may comprise a plurality of recessed portions configured to facilitate the capture of loose debris such as those described and disclosed herein.

These and other modifications and variations to the invention may be practiced by those of ordinary skill in the art without departing from the spirit and scope of the invention, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the invention as further described in such appended claims. Therefore, the spirit and scope of the appended claims should not be limited to the exemplary description of the versions contained herein.

That which is claimed:

1. A nonwoven fabric, comprising:

(i) continuous fibers; and (ii) a blend of staple fibers comprising (a) bicomponent staple fibers substantially devoid of micro-pores, micro-channels, or both, (b) microfiber staple fibers having a plurality of micro-pores, micro-channels, or both, and (c) polyester staple fibers or wettable staple fibers;

wherein the continuous fibers are mechanically entangled with the blend of staple fibers to define the nonwoven fabric.

2. The nonwoven fabric of claim 1, wherein an amount of the continuous fibers is not uniform through a thickness of the nonwoven fabric.

3. The nonwoven fabric of claim 2, wherein the nonwoven fabric comprises a first surface and a second surface, and a first quantity of the continuous fibers is located at the first surface and a second quantity of the continuous fibers is located at the second surface; wherein the first quantity is greater than the second quantity.

4. The nonwoven fabric of claim 3, wherein first quantity is from 1.5 to 10 times greater than the second quantity.

5. The nonwoven fabric of claim 3, wherein the second surface is devoid of the continuous fibers.

6. The nonwoven fabric of claim 1, wherein the continuous fibers comprises from 3 to 20% by weight of the nonwoven fabric.

7. The nonwoven fabric of claim 1, wherein the bicomponent staple fibers comprise a sheath/core configuration, a side-by-side configuration, a pie configuration, an islands-in-the-sea configuration, a multi-lobed configuration, or any combinations thereof.

8. The nonwoven fabric of claim 7, wherein the bicomponent fibers comprise crimps; wherein the crimps increase a loft of the nonwoven fabric.

9. The nonwoven fabric of claim 1, wherein the nonwoven fabric includes wettable staple fibers, and wherein the wettable staple fibers comprise natural fibers, synthetic fibers, or combinations thereof.

10. The nonwoven fabric of claim 1, wherein the nonwoven fabric includes wettable staple fibers, and wherein the wettable staple fibers comprise viscose.

11. The nonwoven fabric of claim 1, wherein the nonwoven fabric includes wettable staple fibers, and wherein the wettable staple fibers comprise hydrophilic-modified polyester staple fibers; wherein the hydrophilic-modified polyester staple fibers comprise a hydrophilic finish coated thereon.

12. The nonwoven fabric of claim 1, wherein the nonwoven fabric comprises a three-dimensional pattern on at least one surface of the nonwoven fabric; wherein the three-dimensional pattern comprises a plurality of recessed portions having an average depth from 1.5 mm to 3 mm.

13. A cleaning system, comprising:

(i) a cleaning implement including a mop frame; and (ii) a nonwoven fabric comprising (a) continuous fibers, and (b) a blend of staple fibers comprising (a) bicomponent staple fibers substantially devoid of micro-pores, micro-channels, or both, (b) microfiber staple fibers having a plurality of micro-pores, micro-channels, or both, and (c) polyester staple fibers or wettable staple fibers;

wherein the continuous fibers are mechanically entangled with the blend of staple fibers to define the nonwoven fabric.

14. The cleaning system of claim 13, wherein an amount of the continuous fibers is not uniform through a thickness of the nonwoven fabric.

15. The cleaning system of claim 14, wherein the nonwoven fabric comprises an attachment side engaging the cleaning implement and including a first quantity of the continuous fibers, and a floor engaging surface (i) having a second quantity of the continuous fibers that is less than the first quantity of the continuous fibers or (ii) being devoid of the continuous fibers.

16. The cleaning system of claim 15, wherein first quantity is from 1.5 to 10 times greater than the second quantity.

17. The cleaning system of claim 13, wherein the nonwoven fabric is releasably engaged by the mop frame and the cleaning implement further comprises a liquid reservoir and spraying mechanism configured to controllably dispense a liquid housed within the liquid reservoir.

18. The cleaning system of claim 17, wherein the cleaning implement further comprises a handle directly or indirectly attached to the mop frame, and wherein the liquid reservoir is mounted directly or indirectly onto the handle.

19. A method of forming a nonwoven fabric, comprising:

(i) forming or providing a web of continuous fibers having a top surface;

(ii) forming or providing a carded web comprising a blend of staple fibers comprising (a) bicomponent staple fibers substantially devoid of micro-pores, micro-channels, or both, (b) microfiber staple fibers having a plurality of micro-pores, micro-channels, or both, and (c) polyester staple fibers or wettable staple fibers;

(iii) positioning the carded web directly or indirectly onto the top surface of the web of continuous filaments; and (iii) mechanically entangling the carded web with the continuous fibers to define a nonwoven fabric.

20. The method of claim 19, wherein the step of mechanically entangling comprises hydroentangling the carded web with the continuous fibers to form a hydroentangled nonwoven fabric.

* * * * *